US005538199A

United States Patent [19]

Biagiotti

[11] Patent Number: 5,538,199

[45] Date of Patent: Jul. 23, 1996

[54] REWINDING MACHINE FOR CORELESS WINDING OF A LOG OF WEB MATERIAL WITH A SURFACE FOR SUPPORTING THE LOG IN THE PROCESS OF WINDING

[75] Inventor: Guglielmo Biagiotti, Lucca, Italy

[73] Assignee: Fabio Perini S.p.A., Lucca, Italy

[21] Appl. No.: 193,954

[22] Filed: Feb. 9, 1994

[30] Foreign Application Priority Data

Feb. 15, 1993 [IT] Italy ..... FI93A0021

[51] Int. Cl.[6] ..... B65H 18/14

[52] U.S. Cl. ..... 242/541.2; 242/DIG. 2; 242/DIG. 3

[58] Field of Search ..... 242/521, 541.2, 242/541.6, 542.2, DIG. 2, DIG. 3

[56] References Cited

U.S. PATENT DOCUMENTS

| | | | |
|---|---|---|---|
| 2,573,188 | 10/1951 | Dyken | 242/541.6 X |
| 2,775,410 | 12/1956 | Schwartz et al. | 242/541.2 |
| 3,850,381 | 11/1974 | Moore | 242/541.2 |
| 4,102,512 | 7/1978 | Lewallyn | 242/541.2 |
| 4,408,727 | 10/1983 | Dropczynski | 242/521 |
| 4,487,377 | 12/1984 | Perini | 242/521 |
| 4,909,452 | 3/1990 | Hertel et al. | 242/521 |
| 5,031,850 | 7/1991 | Biagiotti | 242/521 |
| 5,172,871 | 12/1992 | Schutt et al. | 242/541.2 X |
| 5,222,679 | 6/1993 | Dropczynski et al. | 242/521 |
| 5,368,252 | 11/1994 | Biagiotti | 242/521 |

FOREIGN PATENT DOCUMENTS

| | | | |
|---|---|---|---|
| 0326528 | 8/1989 | European Pat. Off. | 242/541.6 |

*Primary Examiner*—Daniel P. Stodola
*Assistant Examiner*—Emmanuel M. Marcelo
*Attorney, Agent, or Firm*—Francis J. Bouda

[57] ABSTRACT

A rewinding machine for the production of logs (R) of web material (N) without a core comprises: a first winding roller (1) onto which the web material is fed; a second winding roller (3) rotating in the same direction as the first roller and forming a nip (4) therewith through which the web material passes; an actuator and element (15, 17) to move the surface of the second winding roller (3) toward the first winding roller (1); and a separator to sever the web material at the end of the winding thereof to form a log (R). Provision is also made for a surface (21, 21A) supporting the log (R2) in the process of formation and located upstream of the nip (4) between the rollers (1, 3).

8 Claims, 6 Drawing Sheets

Fig. 2A
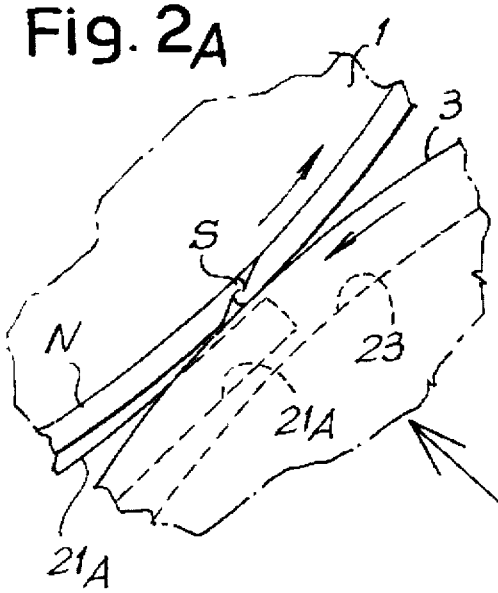
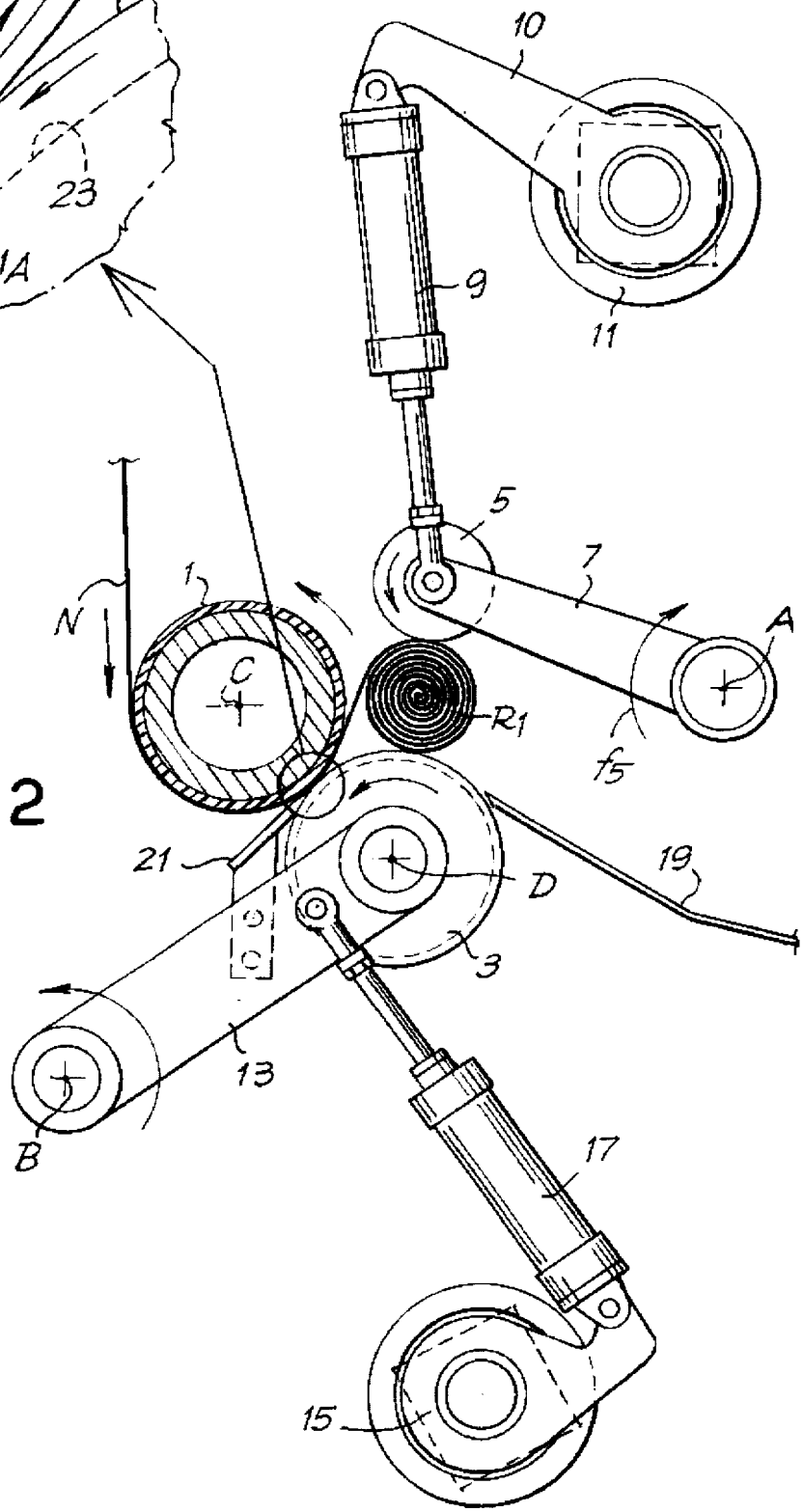
Fig. 2

REWINDING MACHINE FOR CORELESS WINDING OF A LOG OF WEB MATERIAL WITH A SURFACE FOR SUPPORTING THE LOG IN THE PROCESS OF WINDING

BACKGROUND OF THE INVENTION

The invention refers to a rewinding machine for the production of logs of web material which have no core for the winding thereon. Neither does the winding machine have a shaft on which the web is wound.

More in particular, the invention refers to a rewinding machine including: a first winding roller, onto which the web material is fed, and a second winding roller, rotating in the same direction as the first winding roller, which form a nip through which the web material passes; means for moving the surfaces of said winding rollers close to each other; and means for severing said web material at the end of the winding of a log and at the beginning of the winding of the next log.

The invention further refers to a method for the production of rolls or logs of web material wound without central core.

A rewinder of the described type is disclosed in Italian Patent No. 1.201.220. The rewinder constructed according to that patent has some difficulties on the initial stage of the winding.

The invention refers to a new rewinder and to a new method which overcome the drawbacks of these prior art machines.

A first object of the present invention is to provide a rewinder of the type mentioned above, wherein the winding of a log will start in a safe and reliable manner.

A further object of the present invention is to provide a rewinder in which, during the initial stage of the formation of a log, when the free leading edge of the web material begins to wind up on itself to form the initial turns of the log, the log will not tend to move out of the winding nip between the two rollers.

Since the winding begins at the leading edge of the web material itself, without a stiff tubular core or shaft to facilitate the start of the log winding, there is a need to align the log being formed with the axes of the winder rollers. The present invention provides a solution to this problem by enabling the log to immediately position itself in parallel to the axes of the winding rollers.

SUMMARY OF THE INVENTION

These and further objects and advantages, which will become apparent to those skilled in the art by a reading of the following description, are achieved by providing a surface for supporting the log being formed upstream of the nip defined by said winding rollers.

In particular, the support surface may be comb-shaped, with a plurality of teeth, the tips of which are disposed in corresponding annular slots in the surface of the second winding roller, at least during the initial stage of the winding of the log. This arrangement makes it possible to provide a support surface merging without discontinuity into the outer Cylindrical surface of the second winder roller.

When the free leading edge of the web begins to wind up on itself to start the formation of a log (approximately at the center line of the nip between the winding rollers), said log is caused to rotate between the oppositely moving surfaces of the two winding, rollers. The log also moves towards the upstream side of the nip (that at which the web material enters) because of the tension (even if of minimum value) of the web material being wound.

The presence of the support surface upstream of the nip helps the log to overcome the first difficult initial winding phase, which is the most critical one. More in particular, the surface upstream of the nip helps the log to rotate at the very beginning of its formation without tearing the web, by ensuring the alignment of the log with the rollers and preventing the log from moving out of the nip towards the incoming web. During the first winding stage, i.e. when only the first inner core of the log has been formed by a very small number of turns, said log is not rigid (in other words it is quite "soft" and deformable) and can be deformed along its axial extension. Such deformations may bring a portion of the log out of alignment with respect to the theoretical and correct position thereof. When the surface is provided, even if a small portion of the log tends to move upstream, because it loses contact with the second winding roller, the rotation of said log on the fixed support surface, forces said deformed part of the log to move downstream towards the center line of the nip again.

The log in the process of formation then passes through the nip because of difference in peripheral speed between the surfaces of the winding rollers, which difference can be constant or variable. During the initial stage of the winding, that is when the first turns of the log are formed, the speed of the second winding roller may be such as to urge the log slightly backwards (i.e. upstream) so as to move it onto the support surface. This causes the first turns to take a position parallel to the axis of the winding rollers. A proper difference in peripheral speed between the rollers also prevents an undesirably fast advancement of the log in the initial stage, which would cause it to lose its contact with the winding rollers. The control and the displacement of the log while being wound, through a difference in speed between the surfaces of the rollers, requires that the surfaces of the rollers have high coefficient of friction for most of their length.

The invention will be better understood by following the, description and drawings which show practical, not limiting, examples of the invention.

DETAILED DESCRIPTION OF THE INVENTION

In the drawings, FIGS. 1, 2, 3, and 4 show a diagrammatic view of the rewinder according to the invention in four sequential operating steps.

FIG. 2A illustrates an enlarged detail of a portion of FIG. 2.

Figure 1:
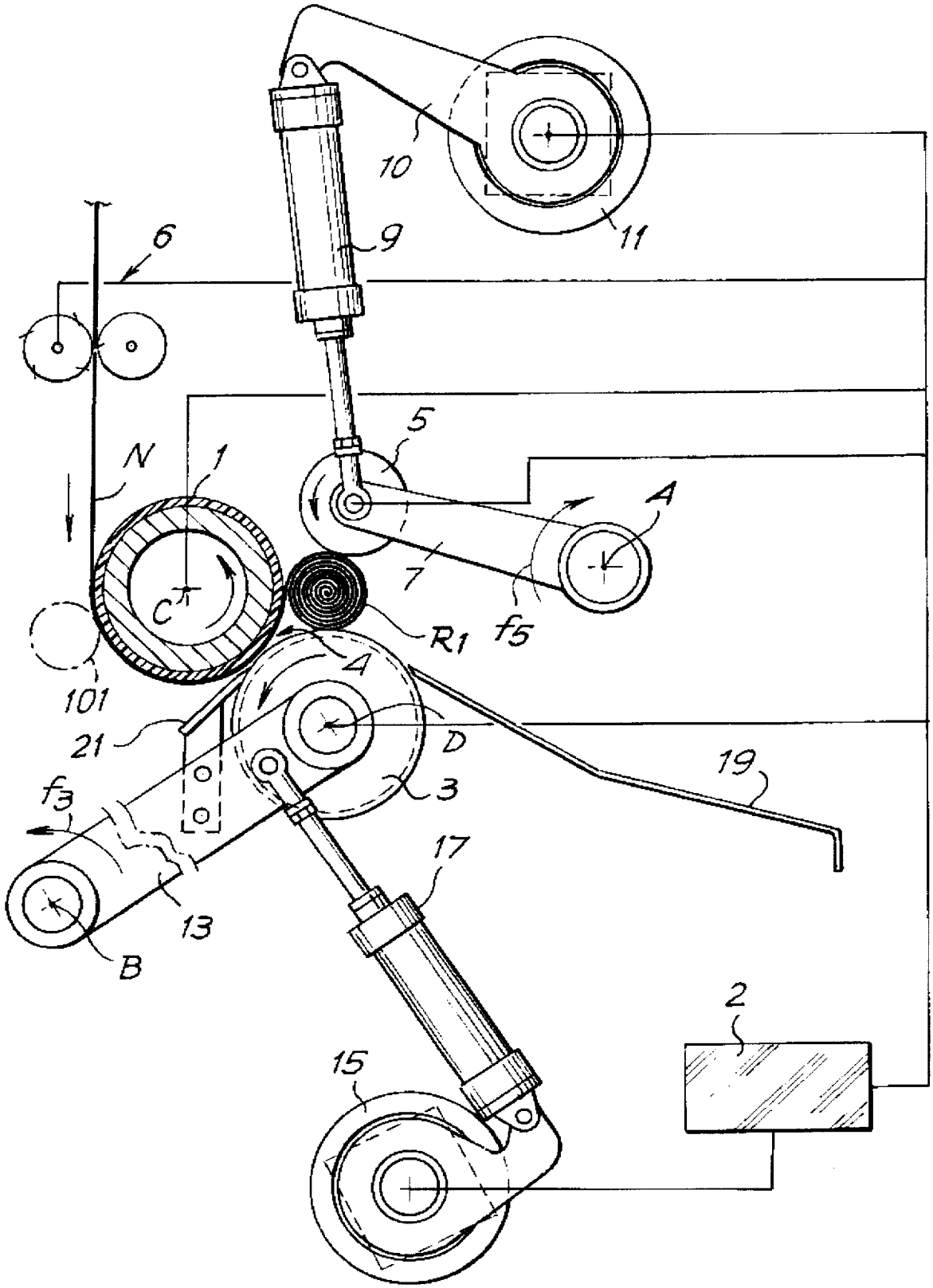

The rewinder, only the basic elements thereof related to the present invention being illustrated, comprises a first winding roller (1) onto which the web material N (coming e.g. from a well-known perforator) is fed. Cooperating with the first winding roller, is a second winding roller (3). The two-winding rollers define a nip (4) through which the web material N passes.

A third movable roller (5) cooperates with the two winding rollers (1) and (3). As shown in the drawings, the roller (5) is carried by an arm (7) which oscillates around an axis A and which is connected, through element (9) and an arm (10), to an actuator (11). The actuator (11) controls the movement of the third roller (5) around the axis A, in the direction of arrow (f5), to allow and control the increasing diameter of the log in the process of formation.

The second winding roller (3) is carried by an arm (13) oscillating according to arrow (f3) around an axis B. The oscillation motion is operated by an actuator (15) which transmits the motion through an element (17) (for example, a pneumatic piston).

Although there is shown the movement of winding roller (3) toward winding roller (1), it is also possible that winding roller (3) does not oscillate and that winding roller (1) is caused to move toward winding roller (3).

Also shown in FIG. 1 is a perforator, schematically indicated by (6), which creates uniformly spaced lines of perforations on the web material (along which the web may be separated) all as well-known in the art.

FIG. 1 shows a log (R1) in the final winding step. The log is kept within the winding space defined by the three rollers (1), (3), (5) rotating in the directions indicated by the arrows. When the log (R1) is completed, it is unloaded towards the surface (19) by varying the speed of rotation of one or both the rollers (3) and (5). For example, the roller (5) may be accelerated, thereby causing a rolling of the log (R1) onto the surface of roller (3).

To allow the unloading of the formed log R1 and thus start the winding of a new log, it is necessary to sever the web material N at a preset moment. In the embodiment of FIGS. 1 to 4, both the tearing of the web material N and the beginning of the winding of the new log are obtained by the roller (3) moving close to roller (1). FIG. 2 shows the moment at which the roller (3) is close enough to roller (1) to pinch the web material N between the rollers (1) and (3).

Figure 3:
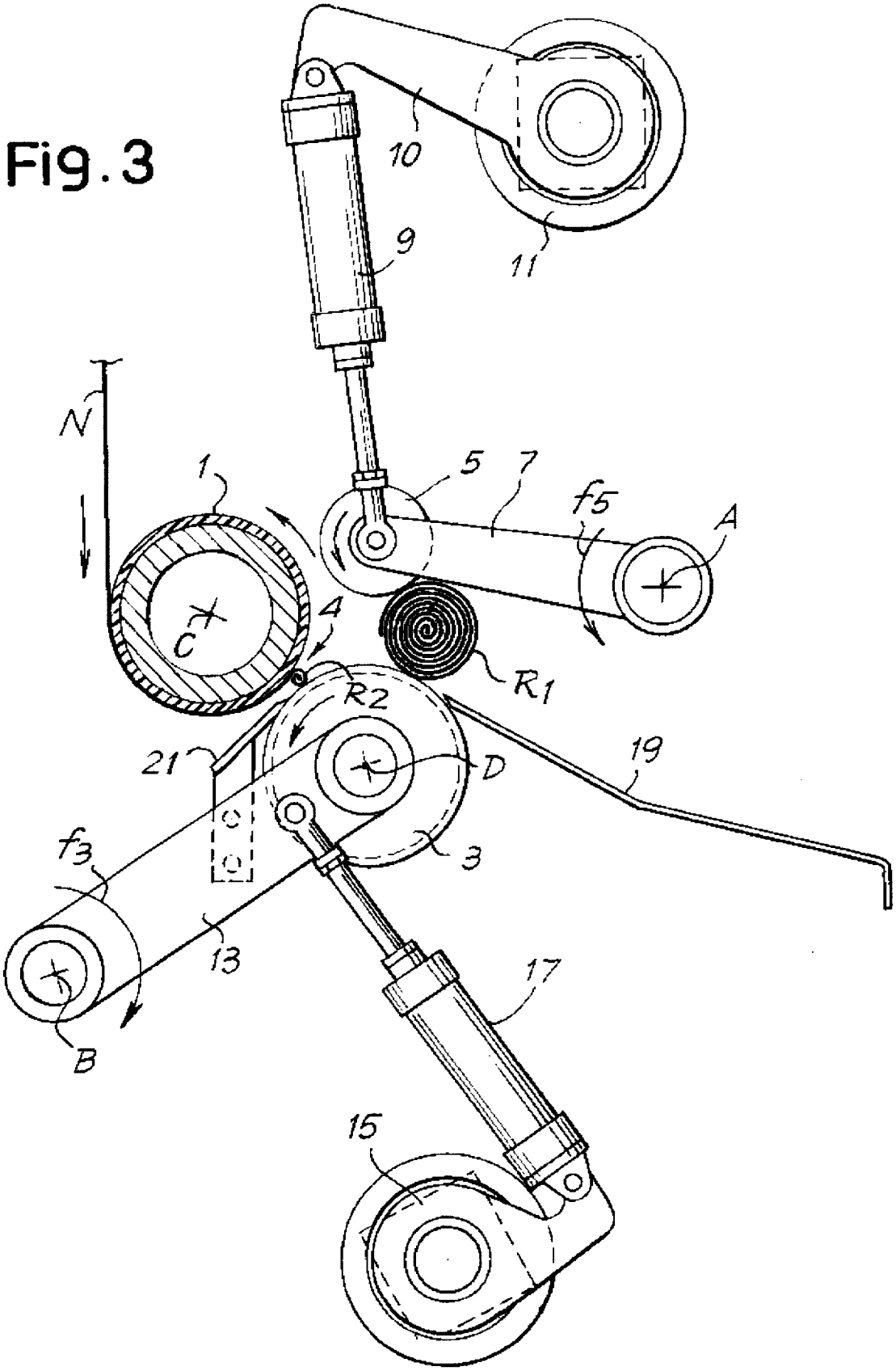

FIG. 2A shows an enlarged detail of the contact region showing how the two rollers (1) and (3) act on web material N to form a loop S. Since the peripheral movement of the two rollers (1) and (3) are in opposite directions, the pinching of the web material has the effect, on one hand, of stopping the advancement of the web thereby causing it to rupture across the web between the loop (S) and the just-completed log R1, while simultaneously initiating the winding of the new log due to the curling up of the free leading edge thus generated. FIG. 3 shows the step of the initiation of the winding of a new log R2, while the completed log R1 rolls towards the surface (19) owing to the difference between the surface speeds of rollers (5) and (3).

The web material usually processed in machines of the type to which the present invention may be applied, is commonly made up of one or more very thin sheets of paper for the production of rolls of toilet paper, all-purpose wipers, such as kitchen towels, and similar articles. This material is very light and is fed at very high speeds ranging from 400 to 800 meters per minute. The feeding from perforator to winding roller takes place at constant speed, and when torn, by the effect of the rotation of the rollers, the web material tends to wind up on itself. However, the first turns of wound material, having no support (neither a cardboard core, nor a shaft or mandrel) to support and give them a straight cylindrical shape, require an accurate control to prevent them from becoming deformed and from being ejected prematurely from the nip between the rollers (in one direction or the other) thus causing the blockage (or jamming and stopping) of the machine.

The present invention facilitates a proper start of the winding of web material on itself by providing a support surface (21) attached to the arm (13) and cooperating with the winding roller (3). The support surface (21) is a comb-like structure with a plurality of teeth (21A) (FIGS. 2A and 6) which extend into corresponding annular slots 23 formed on the cylindrical surface of roller (3). In this way, a substantially continuous surface is defined which is formed partly by the support surface (21) and its relevant teeth (21A), and partly by the cylindrical surface of roller (3).

When the rollers (1) and (3) are moved close to each other and the free edge of the web material N begins to wind up on itself, if the first turns forming the core portion of the log are not parallel to the axes C and D of rollers (1) and (3), the most retracted portion of the log being formed will come in contact with the non-rotating support surface (21), (21A). This causes a thrust effect which forces the log in progress to straighten out with its axis parallel to the axes C and D.

The presence of the support surface (21) makes it possible to prevent misalignment of the log during the very first winding step (that is, when only a few turns are formed by the curling of the free edge) and thus prevent the log from being pulled backwardly from the nip (4) by even a minimal tension in the paper web.

To ensure a better alignment of the log being formed with respect to the axes of the winding rollers, and prevent, at the same time, the log from prematurely leaving the nip (4) toward the roller (5), the second winding roller (3) may be provided, temporarily, with a peripheral speed slightly higher than that of roller (1). This difference in initial speed will tend to move the log towards the support surface (21). Because the support surface (21) is unmovable, the log will tend to remain near the teeth (21A) (where they are within the annular slots (23) of roller (3)), thereby causing the log to take up a position parallel to the axes C, D.

After the winding of a log is properly started, and once the log begins to acquire a significant size, it can be moved through the nip (4) towards the winding region between the rollers (1), (3) and (5). This is obtained by a difference in speed between the roller (3) (rotating with a slightly lower peripheral speed) and the roller (1). The speed of movement of the log through the nip (4) depends on the magnitude of such difference in peripheral speed, and is accompanied by a progressive moving away of the rollers (1) and (3) from each other. Such separating movement, which begins from the formation of the first turns of the leading edge of the web, may be achieved by means of the actuator (15) or even by resilient yielding of the element (17). The magnitude and the law of motion of said separating movement depend on the speed of transit of the log through the nip and, therefore, on the difference between the peripheral speeds of rollers (1) and (3).

Provision may be made for varying the speed of rotation of the lower winding roller (3) during the transit of the log through the nip (4), according to a relation between the peripheral speed of the roller (3) and the diameter of the log and, thus, the instantaneous or temporary nip width.

A central control unit (2) of the machine provides for delivering the acceleration and deceleration operating data to the motors (not shown) which drive and control the speeds of the third roller (5) and the second roller (3). The control unit (2) may also provide for controlling the movement of rollers (1) and (3) toward or away from each other, and of roller (5) with respect to rollers (1), (3). It can also synchronize the perforator (6) with the other machine members, in order to have a perforation line properly positioned during severing of the web material. The control unit (2) is shown only in FIG. 1 and is omitted in the remaining figures for sake of clarity.

The difference in peripheral speed of rollers (1) and (3) may be either constant or variable. In the latter case, a greater difference in speed may be preset creating a faster transit of the log through the nip (4). Moreover, the possibility of varying the speed of the roller (3) allows the winding to be started at a speed slightly greater than that of roller (1) (for the above-described purpose), and then to be continued by decelerating the roller (3), causing the log to move through the nip (4).

Figure 4:
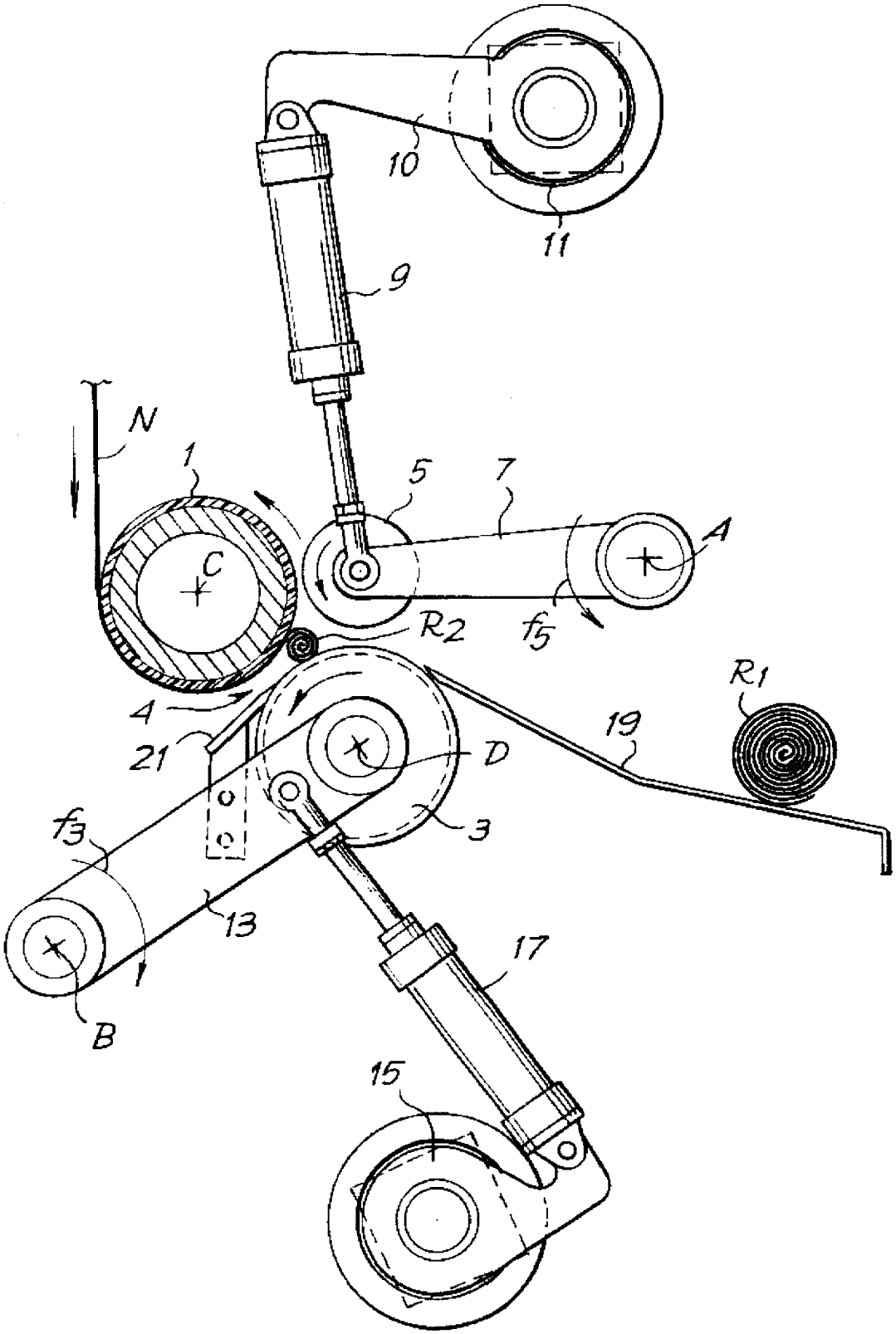

FIGS. 3 and 4 show two successive moments of the transfer step of log R2 to the winding space while the previously formed log R1 is unloaded. In a simplified solution for the machine operation, provision is made for the roller (5) to operate at a constant speed, equal to that of roller (1). In this case, it is the deceleration of roller (3) which causes the rolling of the completed log R1 towards the unloading chute (19). To prevent the completed log R1 from rotating for a too-long time between the rollers (1), (3) and (5), after the web has been severed for the beginning of a new log R2, it is preferred to begin the deceleration of the lower roller (3) before the surfaces of rollers (1) and (3) are pressed one against the other. The control of the log alignment (at this stage the log being formed by just the first few turns of web material) is provided, in this case, by the combined action of the support surface (21) and the proper coefficient of friction of the surfaces of the rollers (1) and (3) preventing the small roll from slipping thereon.

Figure 5:
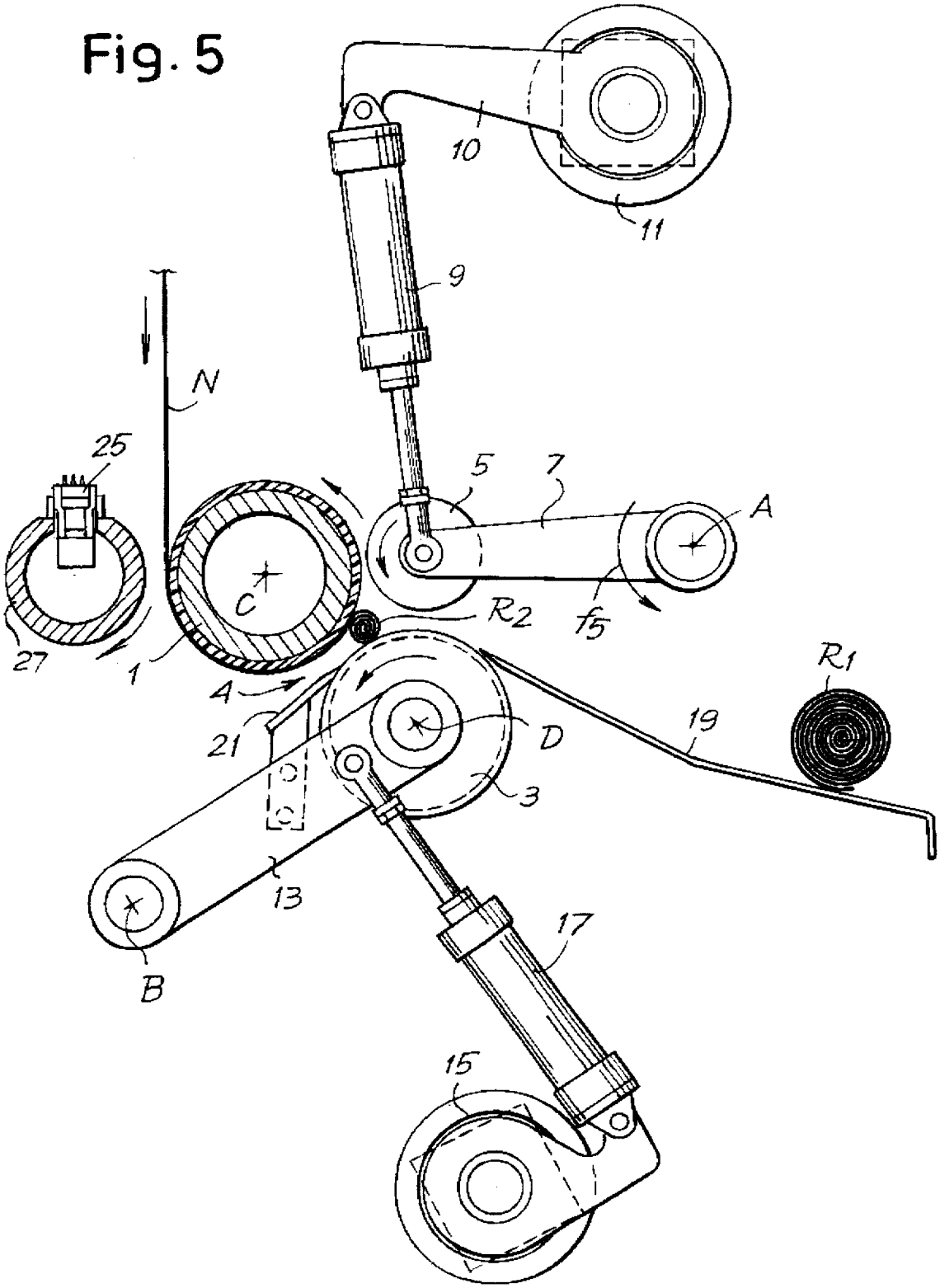
FIG. 5 shows a slightly modified embodiment of the rewinder of the invention.

FIG. 5 shows a modified embodiment wherein the web material N is severed by a cutting or tearing system located upstream of the nip (4). Like numbers indicate corresponding parts of the embodiment of FIGS. 1 to 4.

In this case, the moving of rollers (1) and (3) close to each other provides merely for starting the winding up of the leading edge on itself, while the cutting of the weld is obtained by a cutting member (25) mounted on a cutting cylinder (27) rotating in synchronism with the roller (1). The cutting member cooperates with a channel (29) formed in the surface of roller (1). Near the channel (29) is a row of suction holes (31) which retain the leading edge after the cut, and carry it towards the nip (the region of maximum mutual approach of rollers (1) and (3)) where the winding begins. The cutting member (25) may be movably mounted on the cylinder (27), or the cylinder (27) may be supported on a movable axis to move it close to roller (1). The winding operation of this modified embodiment is similar to what has been described with reference to FIGS. 1 to 4, especially regarding the function of the support surface (21).

Figure 6:
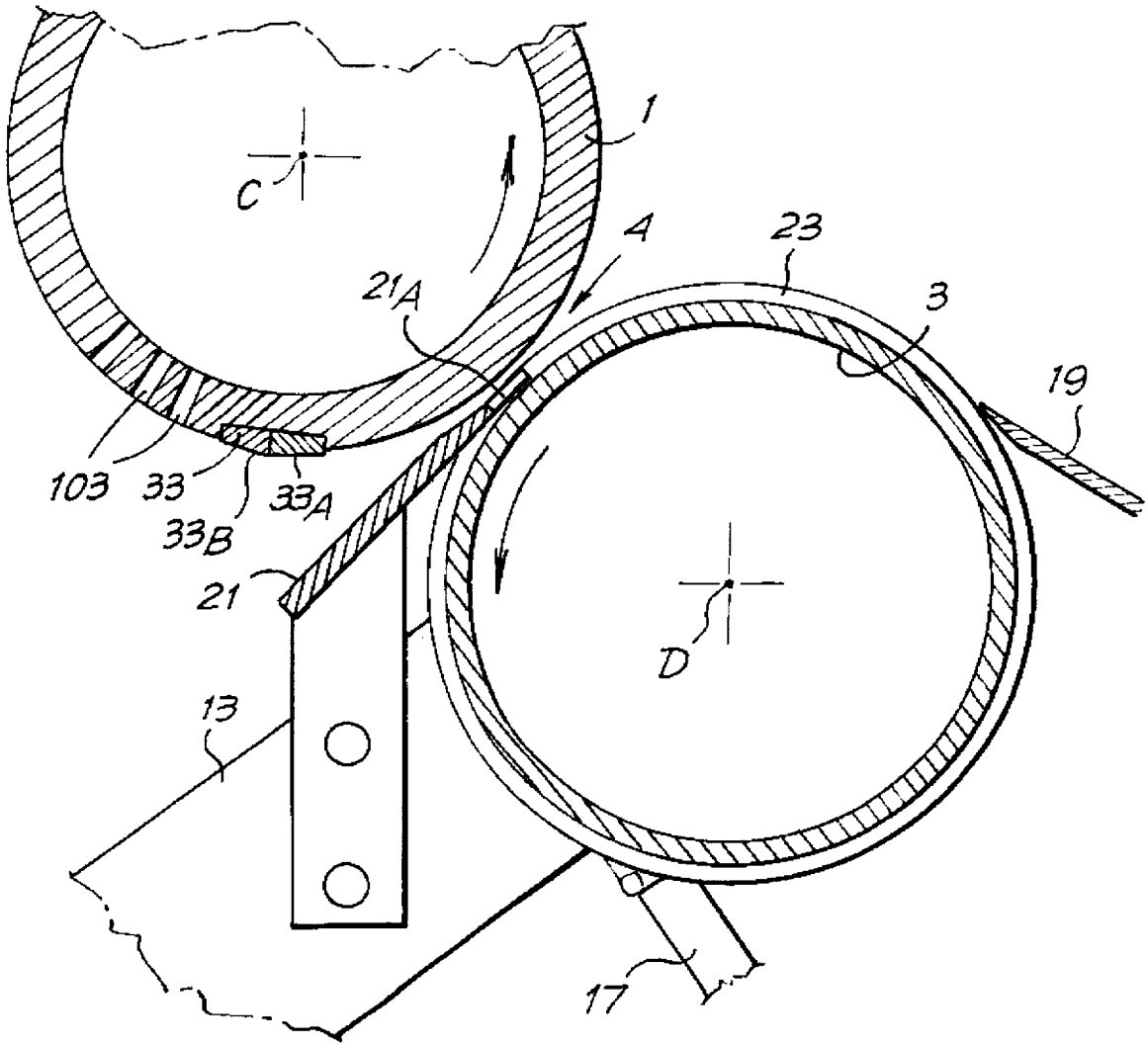
FIG. 6 shows a detail of the winding region with a slightly modified embodiment of the first winder roller.

FIG. 6 shows a detail of the region in which the winding of the log begins. In this figure, the roller (1) has been slightly modified and is provided with a sector (33) which is radially movable in, and extends lengthwise substantially over the whole length of, roller (1). The sector (33) is normally housed within a recess so that its external surface is perfectly aligned with the cylindrical surface of the roller (1). When the web material must be severed to begin the winding of a new log, the roller (3) may be brought close to roller (1) without coming in contact therewith, but remaining at a predetermined minimum distance therefrom. The web material is in this case pinched between the roller (3) and the outer surface of sector (33), the external surface of the latter being allowed at that instant and for that purpose, to extend a few tenths of a millimeter beyond the surface of roller (1). The mechanism for the extension of sector (33) may be similar to that described in Italian Patent No. 1.213.822, the content of which is incorporated by reference in the present description. In the prior patent, a device for the movement of a cutting blade is described, which may be utilized also for the movement of sector (33). Of course, other devices for the movement of sector (33) can be utilized.

Alternatively, the sector (33) could be mounted on the roller (3) instead of on roller (1).

To facilitate the severance of the web material between the nip (where the rollers (1) and (3) move close to each other), and the completed log R1, the movable sector (33) (when it is installed on the roller (1)) is divided into two portions (33A) and (33B) having different characteristics. The portion (33A) may be smooth or at least have a very low coefficient of friction, such as a surface of polished steel.

With this arrangement, by suitably synchronizing the movements of roller (3) and sector (33) with the position of the perforation lines created by the perforator (6) on the web material N, it is possible (when the roller (3) and sector (33) come in contact with each other) to have a line of perforations located on the surface (33A) (or just downstream thereof) at the very instant when the web material is pinched between roller (3) and sector (33). Because the web is more tightly pinched between roller (3) and surface (33B) than between roller (3) and surface (33A), backward slippage of the web material takes place on the surface (33A), and a consequent tearing thereof along the perforation line.

The portion (33B), with high coefficient of friction coming along immediately after the tearing, facilitates the beginning of the winding and the control of the rotation of the first turns of the web during the initial formation of the log.

The arrangement set forth above may be adopted also in the embodiments of FIGS. 1 to 4, by making a narrow, axially longitudinal strip of the surface of roller (1) with lower coefficient of friction than the rest of the surface of roller (1), and/or through a suitable surface treatment. The presence of a low friction surface makes the tearing easier even when the web does not have lines of perforation.

When the surfaces of the winding rollers come in contact with each other to cause the severance of the web material and the beginning of the winding, the web material may have a tendency to become "slack" or loose upstream of the nip. Suitable means may, therefore, be provided to prevent this drop of tension from spreading further upstream in the web material. A means suited to this purpose may consist of a small roller, either of motor-driven or idle type, put in contact with the web material in the region where it is carried around the roller (1). Such a small roller is shown with dotted lines in FIG. 1 and designated by numeral (101). The roller (101) pinches the web against roller (1) and thus prevents the web material N from becoming loose upstream of roller (101).

Further means may be provided to prevent the loosening, such as a plurality of suction holes (103) (see FIG. 6) in the cylindrical wall of roller (1), which cause the web material to adhere to the surface of said roller (1). It will be understood that the two solutions are interchangeable or combinable and may be adopted as an alternative to, or in combination with all the embodiments illustrated in the attached figures. When using the suction system, the vacuum inside the holes (103) may be appropriately timed in a manner known in the art.

To avoid excessive impact or compressive loads between the rollers (1) and (3) when they pinch the web therebetween, and in order to facilitate the beginning of the winding, at least one of said surfaces may be made from yielding material, such as rubber, as illustrated in. FIG. 1 for the roller (1). The yielding portion may also be limited to a single longitudinal strip of surface where the contact takes place with roller (3). Alternatively, the yielding surface may be the slotted surface of roller (3).

It is understood that the drawing shows an exemplification given only as a practical demonstration of the invention, as this may vary in the forms and dispositions without, nevertheless, coming out from the scope of the idea on which the same invention is based. The possible presence of reference numbers in the appended claims has the purpose of facilitating the reading of the claims, reference being made to the description and the drawing, and does not limit the scope of the protection represented by the claims.

Having thus described the invention, what is claimed as new and desired to protect by Letters Patent are the following:

1. A rewinding machine for the production of logs (R) of web material without winding core or winding mandrel including:

a first winding roller (1) onto which the continuous web material is fed from an upstream to a downstream direction;

a second winding roller (3), rotating in the same direction as the first winding roller and forming a nip (4) therebetween through which the web material (N) to be wound passes in an upstream to downstream direction;

means to sever said web material at the end of the winding of a log (R1) and forming a web leading edge, means (15, 17) to move the surfaces of said winding rollers close to one another, the web material being pinched between said winding rollers to start winding of the leading edge upon itself;

a support surface (21, 21A) located upstream of the nip (4) between said rollers (1, 3), the winding of said log starting with said log being arranged in said nip and in contact with said first and second winding rollers (1, 3) and said support surface (21, 21A), and arranged to align the initial winding of the log between the first and second winding rollers.

2. A rewinding machine according to claim 1 wherein said support surface (21, 21A) is comb-shaped and includes a plurality of teeth (21A) which cooperate with respective annular slots (23) on the surface of said second winding roller (3), the tips of said teeth being disposed in said annular slots at least during the initial stage of the winding of the log, with a portion of said support surface projecting upstream from said annular slots (23).

3. A rewinding machine according to claim 1, wherein said second winding roller includes a supporting means (13) and said support surface (21, 21A) is fixed to said supporting means (13).

4. A rewinding machine according to claim 1, including means (2) for controlling the speed of said second winding roller (3) relative to the speed of the first winding roller (1) to cause first a movement of the log backwards, upstream from said nip and towards said support surface, and a subsequent downstream movement of the log to move said log through said nip (4).

5. A method of winding a web material (N) to form coreless logs, including the steps of:

a) providing a first winding roller which carries the web material (N);

b) providing a second winding roller, defining a nip with the first winding roller through which the web material is fed, said winding rollers rotating in the same direction;

c) moving said web from an upstream to a downstream location through said nip;

d) forming a coreless log of said web material;

e) severing the web material at the end of the winding of a log thereby generating a leading edge of said web for the winding of a subsequent log;

f) moving the winding rollers close to each other to grip the web material, near its edge, therebetween, causing the latter to curl upon itself and thus starting the winding of a new log of said web material;

g) retaining the log during the initial winding between said first and said second winding rollers, by supporting said log on a support surface located upstream of said nip with respect to the web feeding direction whereby to align the initial winding of the log between the first and second winding rollers.

6. A method according to claim 5 wherein the speed of at least one of said first and second winding rollers is controlled such that the second winding roller will rotate at a peripheral speed temporarily higher than the peripheral speed of the first winding roller during the initial winding stage of the web material, the difference in the peripheral speed being such as to initially move the log in the process of formation backwards and towards said support surface and subsequently change said peripheral speed such that the log is made to advance and pass through said nip in the moving direction of said web.

7. A method according to claim 6 characterized by changing the difference between the peripheral speeds of the first and second winding rollers during the first stage of the winding of the log between the two rollers as the distance between the axes of said two rollers gradually changes to follow the increase of the log diameter during winding of the log.

8. A method according to claim 5 wherein the approach between the surfaces of the first and second winding rollers is obtained at least partially by a movement in a substantially radial direction of a section of the surface of one of said winding rollers.

* * * * *